US007967264B1

(12) United States Patent
Peterson

(10) Patent No.: US 7,967,264 B1
(45) Date of Patent: Jun. 28, 2011

(54) LADDER ATTACHED SUPPORT BRACKET AND PAINT CAN AND ROLLER PAN HOLDERS FOR USE THEREWITH

(76) Inventor: Lloyd E. Peterson, New Brighton, MN (US)

( * ) Notice: Subject to any disclaimer, the term of this patent is extended or adjusted under 35 U.S.C. 154(b) by 799 days.

(21) Appl. No.: 11/879,044

(22) Filed: Jul. 13, 2007

(51) Int. Cl.
*E06C 7/14* (2006.01)

(52) U.S. Cl. ..... 248/210; 248/222.14; 248/229.14; 248/231.61; 182/115

(58) Field of Classification Search ..... 248/210, 248/238, 222.14, 222.51, 229.14, 229.24, 248/228.5, 231.61; 182/115, 116, 124–126
See application file for complete search history.

(56) References Cited

U.S. PATENT DOCUMENTS

| | | | | | |
|---|---|---|---|---|---|
| 1,114,921 | A | | 10/1914 | Selstad | |
| 1,243,732 | A | | 10/1917 | Goss | |
| 2,677,545 | A | * | 5/1954 | Ross | 482/87 |
| 2,895,700 | A | | 7/1959 | Johnson | |
| 3,125,317 | A | * | 3/1964 | Law | 248/210 |
| 4,025,016 | A | * | 5/1977 | Brothers | 248/210 |
| 4,445,659 | A | | 5/1984 | LaChance | |
| 4,534,528 | A | * | 8/1985 | Rousseau | 248/210 |
| 4,776,550 | A | | 10/1988 | Storey | |
| 5,316,251 | A | | 5/1994 | McGraw | |
| 5,826,844 | A | | 10/1998 | Purdy | |
| 5,960,905 | A | | 10/1999 | Gardner | |
| 6,338,459 | B1 | | 1/2002 | Biggs | |
| 6,398,174 | B1 | * | 6/2002 | Emalfarb | 248/214 |
| 6,494,642 | B1 | * | 12/2002 | Daly | 405/36 |
| 2008/0061201 | A1 | * | 3/2008 | Sasser | 248/210 |

* cited by examiner

*Primary Examiner* — Amy J Sterling
*Assistant Examiner* — Steven M Marsh
(74) *Attorney, Agent, or Firm* — James W. Miller

(57) ABSTRACT

A U-shaped bracket having an adjustable width is telescopically inserted around a side rail of the ladder by pushing the bracket onto the side rail with the open end of the bracket receiving the side rail as the bracket is pushed onto the side rail. Side walls of the bracket have extended wall portions that stick out past the rear of the side rail. A paint can holder can be telescopically inserted through a set of aligned holes in the extended wall portions to couple the paint can holder to the side rail of the ladder. A paint roller pan holder can also be telescopically inserted through a set of aligned holes in the extended wall portion to couple the paint roller pan holder to the side rail of the ladder. The paint roller pan holder includes a pivot connection to allow the portion of the holder that supports a paint roller pan to be leveled relative to the horizontal.

16 Claims, 6 Drawing Sheets

LADDER ATTACHED SUPPORT BRACKET AND PAINT CAN AND ROLLER PAN HOLDERS FOR USE THEREWITH

TECHNICAL FIELD

This invention relates to a support bracket that may be attached to a ladder for supporting an object holding accessory adjacent and to one side of the ladder. The accessory may be a holder for a paint can, or a holder for a paint roller pan, or the like. This invention also relates to paint can and paint roller pan holders themselves.

BACKGROUND OF THE INVENTION

It is difficult when working on a ladder to carry and hold tools, brushes, and/or materials. For example, when a person stands upon one of the rungs of a ladder to paint the side of a structure, it is necessary to hold the paint can in one hand and the brush in the other, all the while maintaining one's balance on the ladder. This is tiring and difficult to do especially over long periods of time. It would not be unusual for a person so situated to drop the brush or spill paint from the can. This leads to unwanted and messy stains which must be cleaned up.

Various devices have been proposed for attachment to a ladder to assist the user in supporting a paint can or in holding tools. Many of these devices are designed to fit or clamp around central portions of one or more of the ladder rungs. When in place, these devices cover at least a portion of a rung that is located above the rung on which the user is standing. If the user wishes to ascend further up the ladder, such passage may be blocked, or at least made more difficult, by the installed device. The device might first have to be removed from the ladder to allow the user to proceed further up the ladder.

Other object holding accessories for a ladder are installed by inserting at least a portion of the accessory into one end of one of the rungs of a hollow rung ladder. For example, U.S. Pat. No. 5,259,525 to Wion shows a paint can holder having a handle or support arm that fits inside a hollow ladder rung. A wedge can be pounded in to wedge or lock the support arm in place.

Some ladder accessory devices are supported on brackets that fit around a side rail of the ladder. One such device is disclosed in U.S. Pat. No. 5,826,844 to Purdy. In the Purdy device, a U-shaped bracket fits around a ladder side rail with an outer wall of the bracket having two slots through which a strap may be threaded. The strap can be tightened around a paint can to support the paint can.

The Purdy device has various disadvantages. If the bracket is installed on the side rail before the strap is inserted, it would be difficult to thread the strap through the slots as these slots would be very close to, if not covered by, the side rail itself. If one attempts to thread the strap and install the paint can before the bracket is installed on the side rail, then it would be awkward and difficult to install the bracket without spilling paint from the paint can. Moreover, the strap is useful only for supporting a tubular type container, such as a paint can, and is not adaptable for holding other things on the side rail of the ladder. Thus, the Purdy bracket and strap system is quite limited in what can be attached to the ladder and would be difficult to install.

U.S. Pat. No. 2,895,700 to Johnson discloses a support bracket that is attached to the side rail of a ladder. The bracket includes outwardly turned flanges having two pairs of aligned vertical holes. A paint can holder in the form of a circular ring has a pair of downwardly extending feet that slip into the pairs of holes on the flanges to support the ring to one side of the ladder in a cantilever fashion. Paint cans of various sizes are then dropped into and supported by the ring. Thus, the Johnson support bracket is able to support the paint can holder without using a flexible strap that has to be threaded through slots in the bracket.

While the brackets shown in the Johnson and Purdy patents are useful in holding paint cans and the like to one side of a ladder, they have various disadvantages. Ladders have differently sized and shaped side rail and rung configurations. Thus, a particular bracket might work well with one ladder but not another. And, even when a bracket purports to be somewhat adjustable, like the bracket of Johnson, the adjustment is somewhat clumsy and time consuming to do. Thus, it will take some time for the user to properly adjust the bracket and install it on the ladder side rail. There is a need in the art for a support bracket that is truly universal in the sense of fitting almost every ladder on the market, but yet is quick and easy to install and uninstall.

In addition, most known brackets are used for supporting a particular object holding accessory that is designed for the particular bracket. As an example, the Johnson patent shows a circular ring for holding a paint can. The paint can is specifically designed with the downwardly extending feet that are necessary to drop the ring down onto the Johnson support bracket. This same structure is not disclosed as being useful for holding other things, such as a paint roller pan.

Moreover, paint roller pans have different characteristics from paint cans and must be supported more carefully than paint cans since the paint in an open paint roller pan is more prone to being spilled than the paint in a paint can. It is more important that a paint roller pan be kept extremely level despite any sideward tilt or inclination of the ladder itself or of the holder. This is not as much of a problem with a paint can since a paint can is deeper than a paint roller pan and the paint can be kept at a lower level in the paint can. But, with a paint roller pan, since the pan is shallow and the paint must be kept closer to the top of the pan to provide a sufficient supply of paint in the pan, leveling of the pan while the pan is supported on the ladder is far more important.

Yet, known attachments or accessories for supporting paint roller pans on ladders do not take this into account or provide for easy leveling of the paint roller pan. They further do not do so on a bracket that is also designed and equally useful for holding paint cans. Thus, there is also a need in the art for a support bracket that may be quickly and easily attached to a ladder and that is equally useful for supporting either a paint can holder or a paint roller pan holder to one side of the ladder. Such a bracket and/or the paint roller pan holder ideally should be able to level the paint roller pan in a quick and easy manner.

SUMMARY OF THE INVENTION

One aspect of this invention relates to a support bracket for attachment to a side rail of a ladder and an object holding accessory for use with the support bracket. A U-shaped bracket has a pair of spaced side walls that include overlapping end walls at right angles to the side walls. The bracket is telescopically inserted around a side rail with the side walls of the bracket overlying inside and outside faces of the side rail and with the end walls overlying a front face of the side rail when the bracket is installed thereon. The end walls are adjustable relative to one another to vary the distance between the side walls to adjust the width of the bracket to accommodate ladder side rails having different widths. The side walls of the bracket are long enough to have extended wall portions thereon that extend past a rear face of the side rail of the ladder when the U-shaped bracket is telescopically installed around the side rail of the ladder with the side walls overlying the inside and outside faces of the side rail. At least one set of aligned holes is provided in the extended wall portions of the side walls. At least one object holding accessory is releasably coupled to the bracket for holding an object laterally outwardly of the outer face of the side rail. The object holding accessory includes a handle that is shaped to be received within the one set of aligned holes with the handle being longer than the distance between the side walls such that the handle extends completely through the bracket with a first end of the handle being located inwardly of an innermost side wall of the bracket.

Another aspect of this invention relates to a support bracket and a paint can holder and a paint roller pan holder for use therewith, the support bracket being attachable to a side rail of a ladder. The support bracket comprises a U-shaped bracket having an open end and an adjustable width. The bracket is telescopically inserted around a side rail of the ladder by pushing the bracket onto the side rail with the open end of the bracket receiving the side rail as the bracket is pushed onto the side rail. The side walls of the bracket having extended wall portions that stick out past the rear of the side rail. A paint can holder can be telescopically inserted through a set of aligned holes in the extended wall portions of the bracket to couple the paint can holder to the side rail of the ladder. A paint roller pan holder can also be telescopically inserted through a set of aligned holes in the extended wall portion to couple the paint roller pan holder to the side rail of the ladder. The paint roller pan holder includes a substantially horizontal pivot connection to allow a portion of the holder that supports a paint roller pan to be leveled relative to the horizontal.

Yet another aspect of this invention relates to a paint roller pan holder for use with a bracket carried on a side rail of a ladder. The paint roller pan holder comprises a handle adapted to be inserted through at least one hole in the bracket to couple the paint roller pan holder to the ladder. A support member is attached to the handle for supporting a paint roller pan. A substantially horizontal pivot connection is provided between the handle and the support member for allowing the support member to be leveled relative to the horizontal.

An additional aspect of this invention relates to a paint can holder for use with a bracket carried on a side rail of a ladder. The paint can holder comprises a handle adapted to be inserted through at least one hole in the bracket to couple the paint can holder to the ladder. A support member is attached to the handle for supporting a paint can. The handle is removably attached to the support member to be disposed in either an assembled, operative position or a non-operative, shipping or storage position. The handle in the operative position thereof extends outwardly away from the support member to be received within the hole in the bracket. The handle in the non-operative position thereof extends inwardly from the support member to be received within an open central area of the support member to reduce the size of the paint can holder for shipping or storage.

BRIEF DESCRIPTION OF THE DRAWINGS

This invention will be described hereafter in the Detailed Description, taken in conjunction with the following drawings, in which like reference numerals refer to like elements or parts throughout.

DETAILED DESCRIPTION

Figure 1:
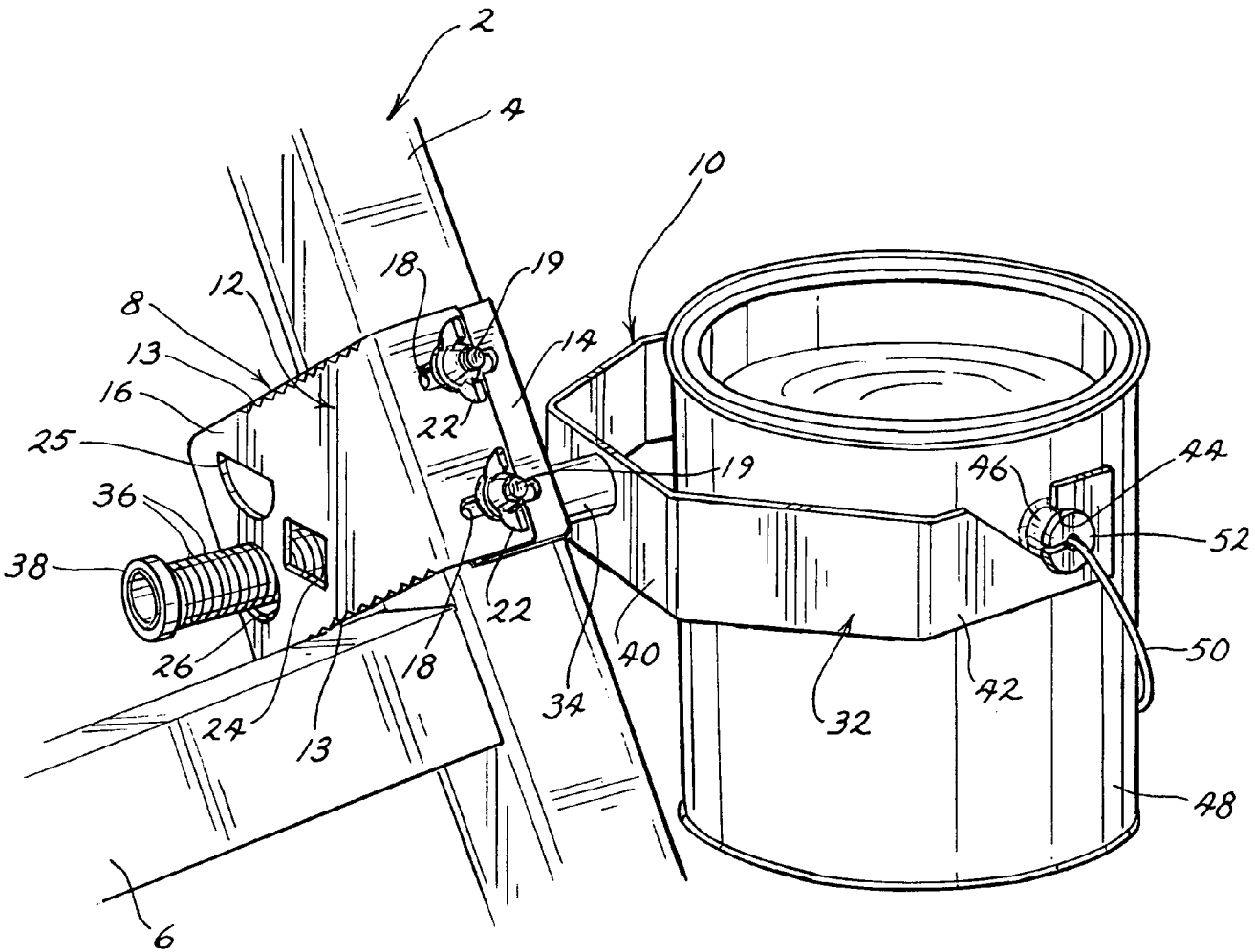
FIG. 1 is a perspective view of a ladder attached support bracket and a paint can holder according to one embodiment of this invention, the bracket being shown attached to one of the side rails of the ladder and the paint can holder comprising a generally U-shaped cradle for supporting a paint can.

A portion of a typical ladder 2 is shown in FIG. 1. Ladder 2 includes first and second, spaced, parallel side rails 4 (only one of which is shown in FIG. 1). A plurality of horizontal rungs 6 extend between side rails 4 at spaced intervals to allow the user to climb or descend ladder 2. Ladder 2 may be of the type which simply leans against a wall or other support surface. Alternatively, ladder 2 may be of the step-ladder type which is freestanding with the portion of ladder 2 that is illustrated being that portion of the step ladder that the user climbs or descends, the other bracing portion of the step ladder not being illustrated in FIG. 1.

Rungs 6 of ladder 2 can be solid as shown in FIG. 1 or can be of the hollow rung type, i.e. a hollow rung open at each end. Moreover, side rails 4 of ladder 2 can have a solid, rectangular configuration as shown in FIG. 1 or can have a channel or I-beam shape as is typical in more modern metallic ladders. Thus, the exact configurations of rungs 6 and/or side rails 4 is unimportant to this invention as long as ladder 2 has such rungs 6 and side rails 4.

One embodiment of this invention comprises, in part, a support bracket 8 that can be easily installed around one ladder side rail 4. Bracket 8 can be used to support an object holding accessory from ladder 2. The object holding accessory can be a paint can holder 10 or a paint roller pan holder 11. A special paint roller pan to be described later is designed for use with paint roller pan holder 11.

Figure 2:
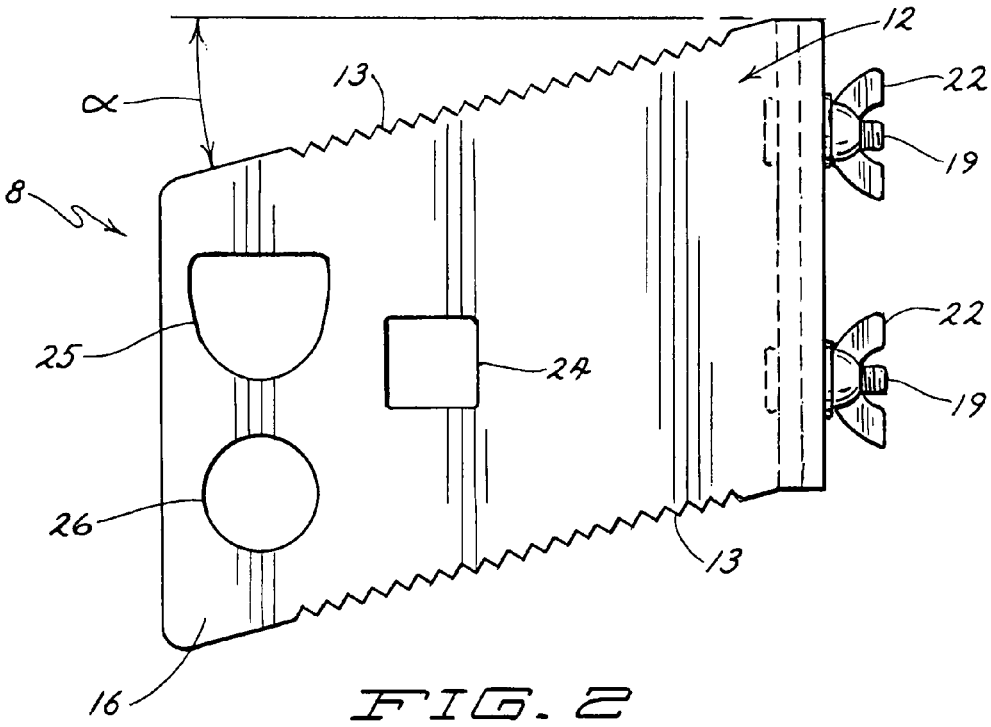
FIG. 2 is a side plan view of the bracket of FIG. 1 with the paint can holder being disconnected from the bracket in FIG. 2.
Figure 3:
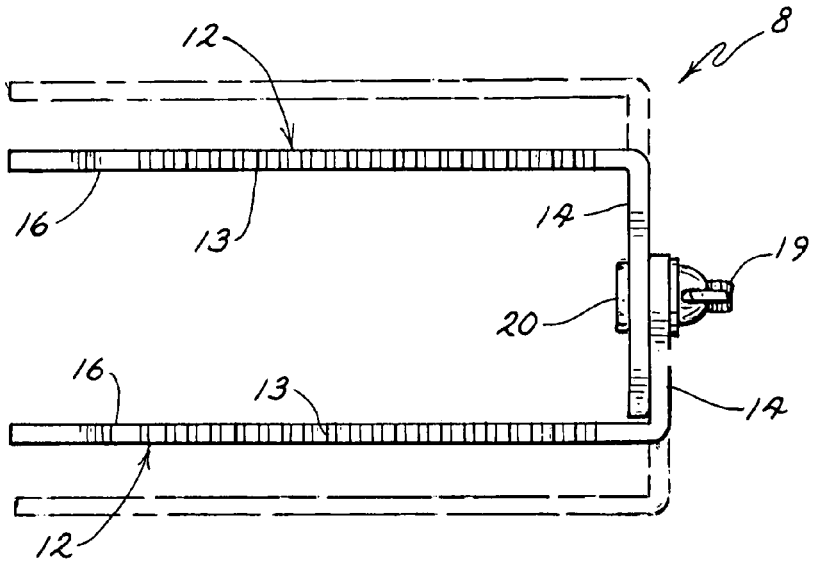
FIG. 3 is a top plan view of the bracket of FIG. 2, particularly showing how the bracket is adjustable in width to accommodate ladder side rails having different widths.

Referring more particularly to FIGS. 1 and 2, bracket 8 is preferably U-shaped having spaced, parallel side walls 12 connected together at one end by a pair of overlapping end walls 14. The other end of side walls 12 is open to allow the open end of U-shaped bracket 8 to be slipped over one side rail 4. When so installed, bracket 8 will have one side wall 12 immediately adjacent the inside face of side rail 4 and the other side wall 12 immediately adjacent the outside face of side rail 4. Preferably, as shown in FIGS. 1 and 2, side walls 12 extend away from end walls 14 at a slight angle to incline downwardly relative to end walls 14, the inclination being depicted by the angle $\alpha$ in FIG. 2.

The lower edge of side wall 12 adjacent the inside face of side rail 4 is adapted to rest on top of or abut against a rung 6 of ladder 2, as shown in FIG. 1. The lower edge of side wall 12 has teeth or serrations 13 to better grip against rung 6 of ladder 2. For manufacturing simplicity and to provide ease of installation regardless of which side rail 4 carries bracket 8 and regardless of whether bracket 8 is installed in upright or inverted orientations, both the upper and lower edges of each side wall 12 have gripping teeth or serrations 13. Each side wall 12 of bracket 8 is generally identical so that a description of one side wall 12 will suffice to describe the other.

Side wall 12 of bracket 8 is longer than side rail 4 so that side wall 12 has an extended wall portion 16 that sticks out beyond side rail 4 into free space behind side rail 4. Extended wall portion 16 of side wall 12 is simply whatever portion of side wall 12 that sticks out beyond side rail 4 when bracket 8 is installed on side rail 4. The length of extended wall portion 16 can vary, but typically comprises anywhere from 25% to 50% of the total length of side wall 12.

Overlapping end walls 14 of bracket 8 have horizontal slots 18 through which the threaded shank 19 of a fastener 20 extends. A wing nut 22 on the end of the threaded shank 19 can be tightened to clamp end walls 14 together in a horizontally adjusted position. Slots 18, fasteners 20, and wing nuts 22 allow the width of bracket 8, i.e. the distance between side walls 12, to be varied to accommodate side rails 4 having different widths. The width of bracket 8 will be set to slightly greater than the thickness of side rails 4. Once the width of bracket 8 is set for a particular ladder, it will not have to be readjusted. However, having a width adjustable bracket 8 allows the bracket 8 to be universal and to be used on a wide array of ladders with side rails 4 of different widths.

Figure 4:
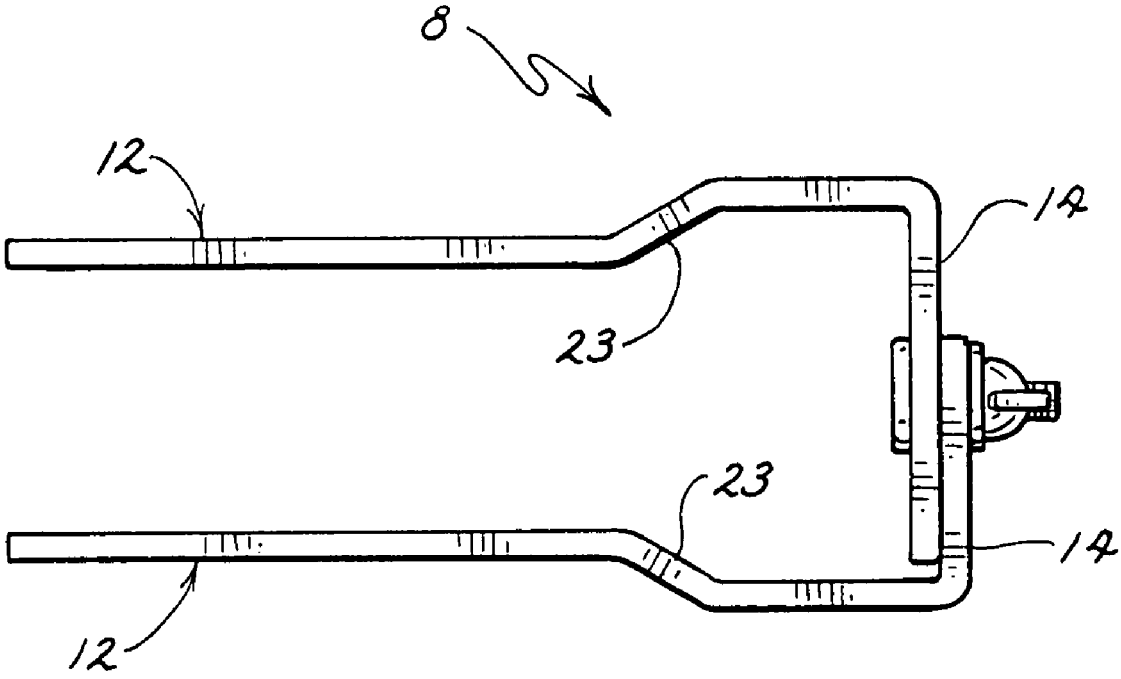
FIG. 4 is a top plan view similar to FIG. 3, but showing an alternate embodiment of the bracket.

FIG. 4 shows an alternative bracket design in which side walls 12 of bracket 8 have necked down portions 23 relatively closely adjacent the overlapping end walls 14. This allows slots 18 to be long enough to provide bracket 8 with enough width adjustability for most current ladders on the market. For example, using necked down portions 23, end walls 4 can be clamped together and side walls 12 can remain closely adjacent the inside and outside faces of side rails 4 even for ladders with side rails 4 of very narrow widths or very large widths. Without such necked down portions 23, a bracket 8 that is large enough to fit around ladders with the widest side rails 4 could not be adjusted down far enough to fit around ladders with the narrowest side rails 4 since the inside overlapping end wall 14 would engage against the opposite side wall 12 and stop out the narrowing adjustment too soon. The presence of necked down portions 23 avoids this result.

Extended wall portion 16 of side wall 12 is provided with three spaced attachment holes 24, 25 and 26. Each attachment hole 24, 25 and 26 preferably has a different shape. For example, as shown in FIGS. 1 and 2, hole 24 could be generally square (or rectangular), hole 25 could be semi-circular, and hole 26 could be round. As between the two side walls 12, the holes 24, 25 and 26 align with one another to form three aligned sets of attachment holes. In other words, the two round holes 26 on the two side walls 12 align with one another to form one set, the two square holes 24 on the two side walls align 12 with one another to form a second set, and the two semi-circular holes 25 align with one another to form a third set.

Figure 5A:
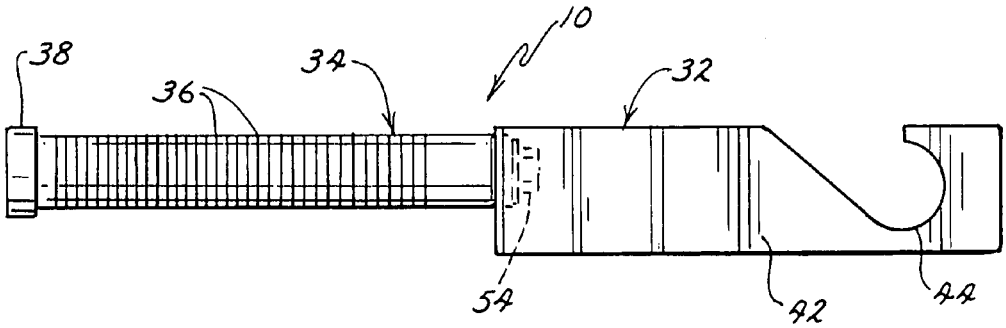
FIG. 5A is a top plan view of the paint can holder of FIG. 1, particularly showing the paint can holder in an assembled, operative configuration.
Figure 5B:
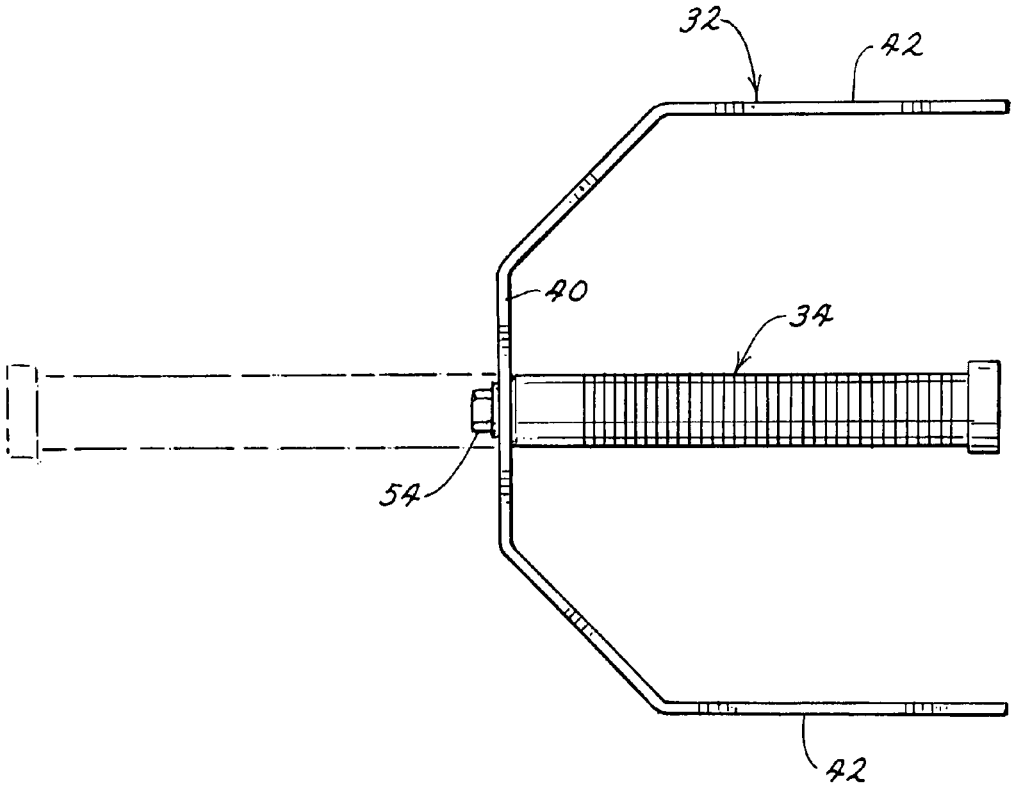
FIG. 5B is a top plan view similar to FIG. 5A, but showing the paint can holder in a disassembled, non-operative configuration in solid lines with the assembled, operative configuration of the paint can holder being shown in phantom.

Referring now to FIGS. 1, 5A and 5B, a paint can holder 10 is shown comprising a paint can holding cradle 32 and an elongated handle 34. Handle 34 preferably has a circular cross-sectional configuration that mates with the shape of the circular holes 26 in side walls 12 of bracket 8. Handle 34 of holder 10 is thus designed to be telescopically inserted through round holes 26 in extended wall portions 16 of side walls 12 of bracket 8.

Handle 34 is long enough to extend all the way through bracket 8 with some room to spare. Thus, handle 34 extends between and is supported by both side walls 12. Handle 34 has threads or ridges 36 along an outer portion of its length and includes an enlarged head 38 at the outer end thereof. The enlarged head 38 is, however, smaller in diameter than the diameter of round holes 26 to allow handle 34 to pass through holes 36. The upward torque on the outer end of handle 34 arising from the weight of the paint can being supported on the opposite end will cause the outer end of handle 34 to slightly incline upwardly thereby causing ridges 36 to engage against the top of hole 26 on the inner side wall 12. In this orientation, the top of the enlarged head 38 will actually be raised higher than the top of hole 26 on the inner side wall 12. See FIG. 1. Both ridges 36 and enlarged head 38 help prevent handle 34 from laterally slipping out of the set of aligned holes 26 in which it is received without the need for a positively engaged fastener or latch.

In the case of paint can holder 10, the holding cradle 32 is generally semi-circular or U-shaped having a base 40 and a pair of forwardly extending arms 42. Arms 42 have outer ends with notches 44 that are designed to fit up under the lugs 46 on either side of a paint can 48 that journal the bail 50. Lugs 46 on paint can 48 can carry enlarged washers 52 that overlie the outside of portions of notches 44. Washers 52 prevent lugs 46 from slipping out of notches 44.

Referring further to FIGS. 5A and 5B, handle 34 is not permanently attached to cradle 32, but is releasably attached by being bolted or screwed to the base 40 of cradle 32 using a threaded fastener 54. This allows holder 10 to be assembled in an operative position in which handle 34 is located on the outside of cradle 32 extending away from base 40 as shown in FIG. 5A. However, this is relatively bulky for the purposes of shipment. Thus, holder 10 can be disassembled and placed into an non-operative, shipping position in which the position of handle 34 is reversed and is nested within the open area of cradle 32. This reduces the size of paint can holder 10 when the product is shipped and sold or even when the product is stored by the ultimate end user.

Desirably, handle 34 attaches to base 40 of cradle 32 above the horizontal centerline of cradle 32. In other words, handle 34 is not symmetrically located on base 40, but is asymmetrically located towards the top of cradle 32. See FIG. 5A. This again helps enhance the ability of handle 34 to remain within aligned holes 26 as the torque arising from paint can 48 in cradle 32 will help pivot handle 34 slightly within holes 26 so that the outer end of handle 34, i.e. the free end of handle 34 that is towards the inside of ladder 2, will be higher than the end of handle 34 attached to base 40. This helps engage ridges 36 with the top of hole 26 on the inner side wall 12 as shown in FIG. 1.

Figure 6:
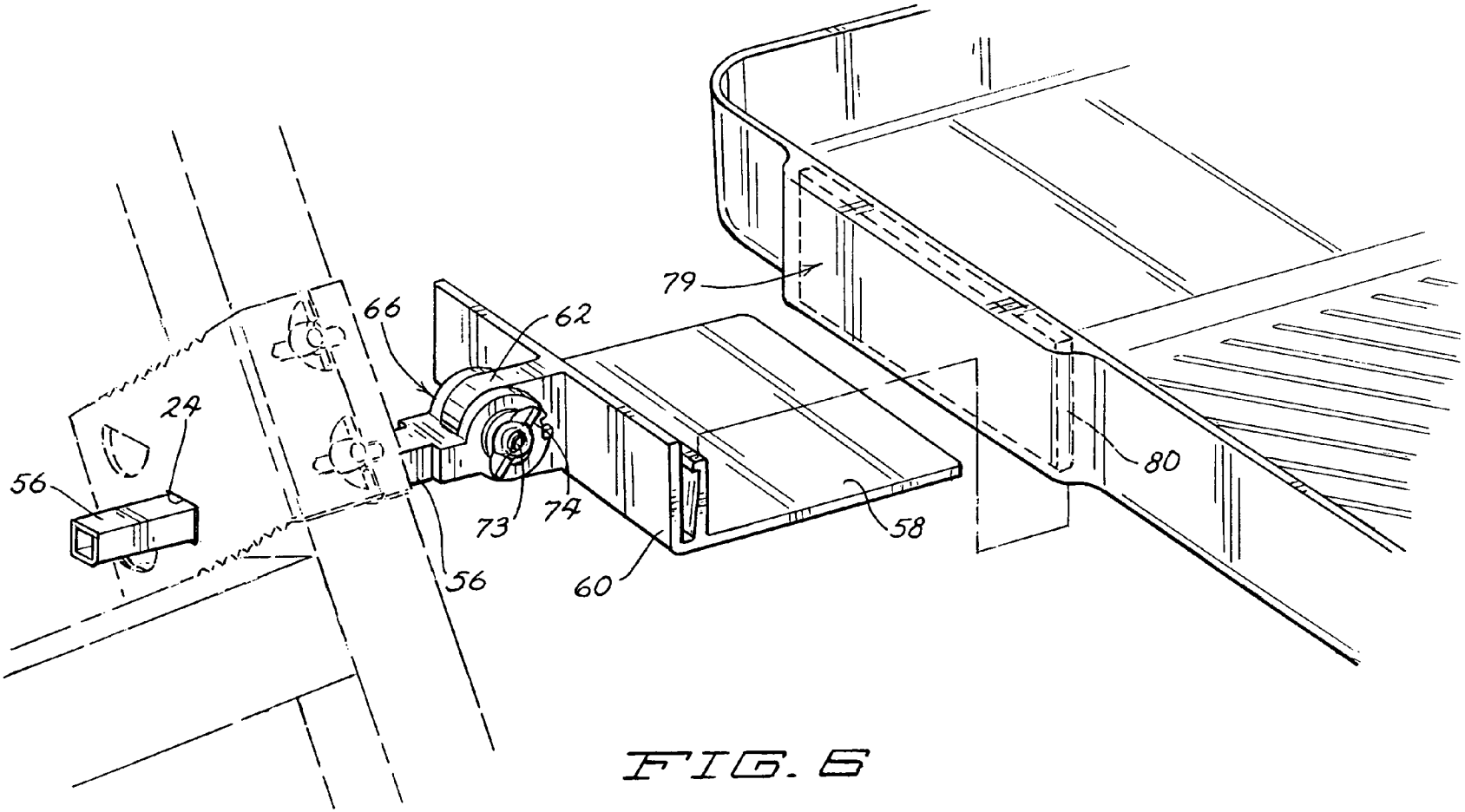
FIG. 6 is a perspective view of a paint roller pan holder according to one embodiment of this invention, particularly showing the paint roller pan holder being used in the bracket of FIG. 1 in place of the paint can holder.
Figure 7:
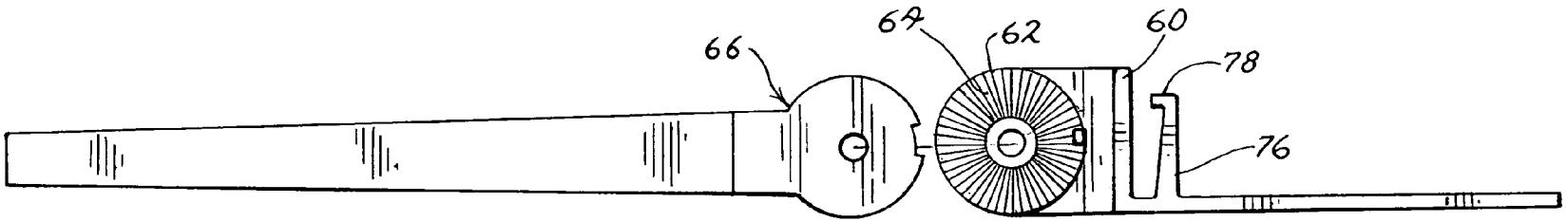
FIG. 7 is an exploded, side elevational view of the paint roller pan holder of FIG. 6.

Turning now to FIGS. 6 and 7, a paint roller pan holder 11 can also be used with bracket 8. Paint roller pan holder 11 comprises an elongated handle 56 that is attached to and carries a substantially horizontal shelf 58. Handle 56 desirably has a square (or rectangular) cross-section designed to fit within aligned holes 24. Like handle 34 of paint can holder 10, handle 56 of paint roller pan holder 11 is long enough to comfortably span the distance between bracket side walls 12 with additional length to spare. See FIG. 6. When so inserted, paint roller pan holder 11 will support a paint roller pan 59 adjacent and outside of one of the side rails 4 of ladder 2. Again, see FIG. 6.

Figure 8:
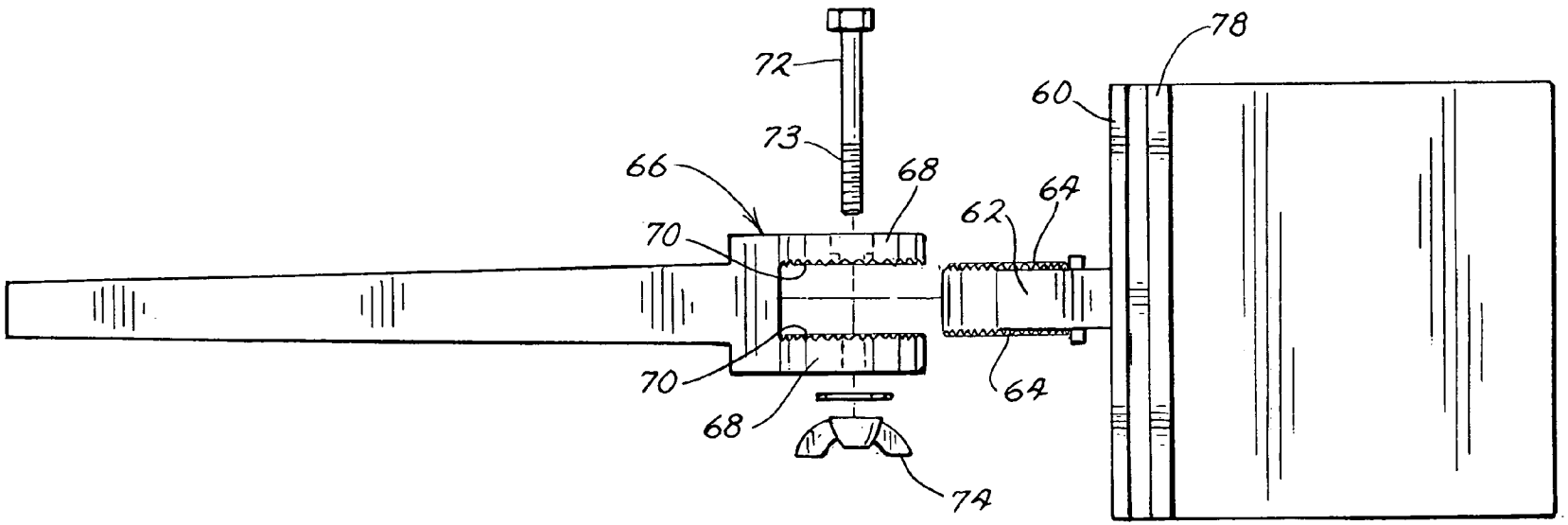
FIG. 8 is an exploded, top plan view of the paint roller pan holder of FIG. 6.

Paint roller pan holder 11 is able to level shelf 58 regardless of any side to side inclination of ladder 2 or handle 56. As shown in FIGS. 7 and 8, shelf 58 has a vertical side wall 60 that supports a fixed, circular hub 62 that extends away from side wall 60 and away from shelf 58. The opposite sides or faces of hub 62 have a plurality of radial teeth or serrations 64.

The inner end of handle 56 has a U-shaped yoke 66 that includes circular end walls 68. Yoke 66 is designed to fit or nest around hub 62 with each end wall 68 of yoke 66 having an inner face adjacent one face of hub 62. The inner faces of end walls 68 carry a plurality of radial teeth or serrations 70 that mate with the teeth or serrations 64 on hub 62. A bolt 72 having a threaded outer end 73 and a wing nut 74 carried on outer end 73 adjustably lock the yoke 66 and hub 62 together.

Hub 62 and yoke 66 obviously form a horizontal pivotal adjustment that allows the angle between handle 56 and shelf 58 relative to the horizontal to be adjusted. For example, after handle 56 is inserted through holes 24, if handle 56 tilts or inclines relative to the horizontal as it extends to the side, this would mean that shelf 58 would be similarly tilted or inclined, giving rise to the possibility of spilling paint from paint roller pan 59 supported on shelf 58. To prevent this from happening, wing nut 74 can be loosened to free up the pivotal connection formed by bolt 72, and then shelf 58 can be pivoted upwardly as needed to reach a level orientation. Once shelf 58 has been leveled, wing nut 74 can be retightened to lock shelf 58 in place on handle 56 in its leveled orientation. Serrations 64 and 70 help serve as detents in this leveling orientation and further help to securely hold or lock shelf 58 in an adjusted position on handle 56. Serrations 64 and 70 could be deleted if desired.

Shelf 58 of paint roller pan holder 11 can have many forms for supporting and holding a paint roller pan thereon. However, preferably, shelf 58 is designed for use with a particular paint roller pan 59 so that the two positively mate and coact with one another to securely hold the paint roller pan 59 atop shelf 58. In this regard, shelf 58 is provided with a vertical, upwardly extending, tapered flange 76 having an L-shaped upper end 78. Flange 76 is set atop shelf 58 close to but to one side of wall 60. Each side of paint roller pan 59 is provided with an enlarged boss 79 that includes a downwardly facing pocket 80 that receives and fits down onto flange 76. The L-shaped upper end 78 of flange 76 is received relatively snugly within pocket 80 to help secure paint roller pan 59 to shelf 58. With this type of connection, shelf 58 need not be as large as the paint roller pan 59 itself and only partially underlies the bottom of paint roller pan 59.

The purpose of having two bosses 78 and two pockets 80, one of each on either side of paint roller pan 59, is to allow paint roller pan 59 to be installed atop shelf 58 in reversed orientations if so desired by the user. Thus, the paint containing well of paint roller pan 59 can be set either forwardly or rearwardly of side rail 4 depending upon the user's preference.

While preferred, the use of flange 76, bosses 79 and pockets 80 could be deleted. Shelf 58 could be enlarged and simply used as a base to underlie most if not all of a conventional paint roller pan. However, in this event, it would still be desirable to have some type of stop or latch to prevent the paint roller pan from being knocked or bumped off shelf 58. For example, shelf 58 could be a tray with raised sides into which a paint roller pan would be dropped in a nested configuration.

Bracket 8 is very easy to install on a side rail of a ladder simply by adjusting the width of bracket 8 to conform to the width of the side rail and then simply sliding bracket 8 around side rail 4. Bracket 8 will naturally assume an orientation in which serrations 13 on inner side wall 12 engage on a rung 6 of ladder 2 as shown in FIG. 1 to help hold bracket 8 in place. The width of bracket 8 is easily adjustable by sliding the overlapping end walls 14 of bracket 8 towards or away from one another and by tightening the wing nuts 22 after an appropriate spacing is reached. Thus, bracket 8 is universally adapted to fitting on most known ladders.

Once bracket 8 is so installed, either paint can holder 10 or paint roller pan holder 11 can be inserted through appropriate sets of the aligned holes 24, 25 or 26. This can be simply and quickly done just by telescopic insertion of the handles 34 or 56 of holders 10 and 11, respectively. Handle 34 is designed to physically engage the top edge of the inner hole 26 to help keep paint can holder 10 in place. Similarly, handle 56 is inwardly tapered from its inner end to its outer free end to wedge itself into place in holes 24 to help keep paint roller pan holder 11 in place. If need be, the inclination of shelf 58 relative to handle 56 can be quickly and easily adjusted to allow shelf 58, and thus any paint roller pan 59 supported thereby, to be level. All in all, bracket 8 and holders 10 and 11 provide a versatile and adaptable system for allowing a user to support various paint receptacles and utensils adjacent a ladder.

Semi-circular holes 25 and round holes 26 are also desirably large enough to receive other accessories made by other manufacturers that normally slip into the interior of the rungs of ladders with hollow rungs. Most existing ladders with hollow rungs have either circular openings or semi-circular openings. Holes 25 and 26 are designed to mimic the shape of such openings to adapt bracket 8 for use with third party object holding accessories.

Various modifications of this invention will be apparent to those skilled in the art. For example, other accessory devices could be installed in holes 24, 25, and 26. For example, rather than supporting a paint roller pan 59, shelf 58 of holder 11 could be used to support a compartmentalized pan that holds various tools, such as wrenches, screwdrivers and the like. Thus, the scope of this invention is to be limited only by the appended claims.

I claim:

1. A support bracket for attachment to a side rail of a ladder and an object holding accessory for use with the support bracket, which comprises:

(a) a U-shaped bracket having a pair of spaced side walls that include overlapping end walls at right angles to the side walls, wherein the bracket is telescopically inserted around a side rail with the side walls of the bracket overlying inside and outside faces of the side rail and with the end walls overlying a front face of the side rail when the bracket is installed thereon, and wherein the end walls are adjustable relative to one another to vary the distance between the side walls to adjust the width of the bracket to accommodate ladder side rails having different widths;

(b) wherein the side walls of the bracket are long enough to have extended wall portions thereon that extend past a rear face of the side rail of the ladder when the U-shaped bracket is telescopically installed around the side rail of the ladder with the side walls overlying the inside and outside faces of the side rail;

(c) at least one set of aligned holes in the extended wall portions of the side walls; and (d) at least one object holding accessory that may be releasably coupled to the bracket for holding an object laterally outwardly of the outer face of the side rail, wherein the object holding accessory includes a handle that is shaped to be received within the one set of aligned holes with the handle being longer than the distance between the side walls such that the handle extends completely through the bracket with a first end of the handle being located inwardly of an innermost side wall of the bracket, wherein the accessory includes a U-shaped cradle on a second end of the handle for holding a paint can.

2. The support bracket and accessory of claim 1, wherein the handle has ridges adjacent the first end of the handle, and wherein the handle has a sufficiently loose fit within the aligned holes such that the first end of the handle inclines upwardly relative to the innermost side wall with the ridges engaging against a top edge of the hole in the innermost side wall to help retain the handle of the accessory within the aligned holes.

3. The support bracket and accessory of claim 1, wherein the first end of the handle includes an enlarged head, and wherein the handle has a sufficiently loose fit within the aligned holes of the bracket such that the first end of the handle inclines upwardly relative to the innermost side wall with at least a portion of the enlarged head of the handle rising above a top edge of the hole in the innermost side wall to help retain the handle of the accessory within the aligned holes.

4. The support bracket and accessory of claim 1, wherein the handle is removably attached to a base of the U-shaped cradle to extend outwardly away from the base when the accessory is an assembled, operative position, the handle being removable from the base and being capable of being reattached to the base with the handle extending inwardly from the base with the handle located in an open central area of the cradle to dispose the accessory in a non-operative, shipping or storage position.

5. The support bracket and accessory of claim 1, wherein the support bracket includes a second set of aligned holes having a different cross-sectional shape than that of the first set of aligned holes, and further including a second object holding accessory having a handle that is shaped to be received within the second set of aligned holes with the handle being long enough to extend completely through the second set of aligned holes.

6. The support bracket and accessory of claim 5, wherein the second object holding accessory is a paint roller pan holder.

7. The support bracket and accessory of claim 6, wherein the paint roller an holder comprises a substantially planar shelf that underlies at least a portion of a paint roller pan when the paint roller pan is supported thereon.

8. The support bracket and accessory of claim 7, further including an upwardly extending flange on the shelf that fits within a pocket on the paint roller pan to help retain the paint roller pan on the shelf.

9. The support bracket and accessory of claim 8, wherein the upwardly extending flange has an L-shaped upper end to wedge within the pocket when the flange and pocket are nested together.

10. The support bracket and accessory of claim 6, further including a pivot to allow the paint roller an holder to be pivoted upwardly and downwardly about a horizontal pivot axis such that the paint roller an holder can be leveled.

11. The support bracket and accessory of claim 1, wherein the side walls of the bracket are inclined downwardly at an angle relative to the end walls.

12. The support bracket and accessory of claim 1, wherein the side walls of the support bracket have necked down portions adjacent the overlapping end walls to provide greater width adjustability.

13. The support bracket and accessory of claim 1, wherein the overlapping end walls have horizontal slots with at least one fastener passing therethrough, wherein the end walls may be slid apart to different distances because of the slots and held in an adjusted position by the fastener.

14. A support bracket for attachment to a side rail of a ladder and an object holding accessory for use with the support bracket, which comprises:

(a) a U-shaped bracket having a pair of spaced side walls that include overlapping end walls at right angles to the side walls, wherein the bracket is telescopically inserted around a side rail with the side walls of the bracket overlying inside and outside faces of the side rail and with the end walls overlying a front face of the side rail when the bracket is installed thereon, and wherein the end walls are adjustable relative to one another to vary the distance between the side walls to adjust the width of the bracket to accommodate ladder side rails having different widths;

(b) wherein the side walls of the bracket are long enough to have extended wall portions thereon that extend past a rear face of the side rail of the ladder when the U-shaped bracket is telescopically installed around the side rail of the ladder with the side walls overlying the inside and outside faces of the side rail;

(c) at least one set of aligned holes in the extended wall portions of the side walls; and (d) at least one object holding accessory that may be releasably coupled to the bracket for holding an object laterally outwardly of the outer face of the side rail, wherein the object holding accessory includes a handle that is shaped to be received within the one set of aligned holes with the handle being longer than the distance between the side walls such that the handle extends completely through the bracket with a first end of the handle being located inwardly of an innermost side wall of the bracket, wherein at least lower edges of the side walls of the bracket are serrated to grip an edge of a ladder rung.

15. A paint can holder for use with a bracket carried on a side rail of a ladder, which comprises:

(a) a handle adapted to be inserted through at least one hole in the bracket to couple the paint can holder to the ladder;

(b) a support member attached to the handle for supporting a paint can, wherein the support member has a shape that defines an open central area such that the shape of the support member at least partially surrounds the paint can with the paint can at least being partially received within the open central area of the support member when the paint can is supported on the support member; and (c) wherein the handle is removably attached to the support member to be connected to the support member in either an assembled, operative position or a non-operative, shipping or storage position, wherein the handle when connected to the support member in the operative position thereof extends outwardly away from the support member with the handle being disposed substantially entirely outside of the open central area of the support member to allow the handle to be received within the hole, and wherein the handle when connected to the support member in the non-operative position thereof extends inwardly from the support member to lie substantially flat within the open central area of the support member and to be substantially entirely received within the open central area of the support member to reduce the size of the paint can holder for shipping or storage.

16. A support bracket for attachment to a side rail of a ladder and an object holding accessory for use with the support bracket, which comprises:

(a) a U-shaped bracket having a pair of spaced side walls that include overlapping end walls at right angles to the side walls, wherein the bracket is telescopically inserted around a side rail with the side walls of the bracket overlying inside and outside faces of the side rail and with the end walls overlying a front face of the side rail when the bracket is installed thereon, and wherein the end walls are adjustable relative to one another to vary the distance between the side walls to adjust the width of the bracket to accommodate ladder side rails having different widths;

(b) wherein the side walls of the bracket are long enough to have extended wall portions thereon that extend past a rear face of the side rail of the ladder when the U-shaped bracket is telescopically installed around the side rail of the ladder with the side walls overlying the inside and outside faces of the side rail;

(c) at least one set of aligned holes in the extended wall portions of the side walls;

(d) at least one object holding accessory that may be releasably coupled to the bracket for holding an object laterally outwardly of the outer face of the side rail, wherein the object holding accessory includes a handle that is shaped to be received within the one set of aligned holes with the handle being longer than the distance between the side walls such that the handle extends completely through the bracket with a first end of the handle being located inwardly of an innermost side wall of the bracket; and (e) wherein the handle has a sufficiently loose fit within the aligned holes such that the first end of the handle inclines upwardly relative to the innermost side wall with a portion of the upwardly inclined first end of the handle engaging against a top edge of the hole in the innermost side wall to help retain the handle of the accessory within the aligned holes.

* * * * *

UNITED STATES PATENT AND TRADEMARK OFFICE

CERTIFICATE OF CORRECTION

PATENT NO. : 7,967,264 B1
APPLICATION NO. : 11/879044
DATED : June 28, 2011
INVENTOR(S) : Lloyd E. Peterson It is certified that error appears in the above-identified patent and that said Letters Patent is hereby corrected as shown below:

IN THE CLAIMS:

Col. 9, Claim 7, Line 44, change “an” to --pan--;
Col. 9, Claim 10, Line 56, change “an” to --pan--; and
Col. 9, Claim 10, Line 58, change “an” to --pan--.

Signed and Sealed this
Sixth Day of September, 2011

David J. Kappos

David J. Kappos
*Director of the United States Patent and Trademark Office*